US008197394B2

(12) United States Patent
Giro Amigo

(10) Patent No.: US 8,197,394 B2
(45) Date of Patent: Jun. 12, 2012

(54) METHOD FOR ALTERING THE STORAGE CAPACITY OF A TUBULAR MESH BAG BY ALTERING THE QUANTITY OF MATERIAL PER UNIT LENGTH

(75) Inventor: Ezequiel Giro Amigo, Badalona (ES)

(73) Assignee: Girnet Internacional, S.L., Bandalona (ES)

( * ) Notice: Subject to any disclaimer, the term of this patent is extended or adjusted under 35 U.S.C. 154(b) by 0 days.

(21) Appl. No.: 12/720,450

(22) Filed: Mar. 9, 2010

(65) Prior Publication Data

US 2010/0167894 A1 Jul. 1, 2010

Related U.S. Application Data

(62) Division of application No. 11/370,023, filed on Mar. 8, 2006, now Pat. No. 7,780,589.

(30) Foreign Application Priority Data

Mar. 14, 2005 (ES) ..... 200500583

(51) Int. Cl.
*B31F 1/00* (2006.01)

(52) U.S. Cl. ..... 493/437; 493/428; 493/248

(58) Field of Classification Search ..... 493/428, 493/437, 248, 258, 259, 410, 436, 438, 439, 493/440

See application file for complete search history.

(56) References Cited

U.S. PATENT DOCUMENTS

| | | | | |
|---|---|---|---|---|
| 3,291,007 | A | 12/1966 | McDowell | |
| 3,566,756 | A | 3/1971 | Schmid et al. | |
| 3,903,677 | A | 9/1975 | Bowman et al. | |
| 4,650,406 | A | 3/1987 | Peters | |
| 5,142,846 | A | 9/1992 | Alameda | |
| 5,246,416 | A | 9/1993 | Demura et al. | |
| 5,823,683 | A * | 10/1998 | Antonacci et al. | 383/107 |
| 5,912,197 | A * | 6/1999 | Madderom | 442/305 |
| 5,957,823 | A | 9/1999 | Fan | |
| 6,019,713 | A | 2/2000 | Scypinski et al. | |
| 6,080,093 | A | 6/2000 | Henderson et al. | |
| 6,145,282 | A | 11/2000 | Tsuruta | |
| 6,506,429 | B1 * | 1/2003 | Recchia, Jr. | 426/106 |
| 6,592,505 | B2 | 7/2003 | Seeberger | |
| 6,729,109 | B2 | 5/2004 | Knoerzer et al. | |
| 7,837,388 | B1 * | 11/2010 | Hefner et al. | 383/117 |

FOREIGN PATENT DOCUMENTS

| | | |
|---|---|---|
| EP | 0 047 544 A | 3/1982 |
| EP | 0 769 367 A | 4/1997 |
| EP | 1 031 512 A | 8/2000 |
| EP | 1 180 430 A | 2/2002 |
| EP | 1 375 353 A | 1/2004 |

(Continued)

*Primary Examiner* — Sameh H. Tawfik
(74) *Attorney, Agent, or Firm* — Sughrue Mion, PLLC

(57) ABSTRACT

It is disclosed a device (1) for altering the storage capacity of a tubular mesh bag of heat sealable material during the manufacture thereof and the bag (15) obtained from its using. The device comprises an expansion core (2) to which the tubular mesh is peripheral, which is essentially oblong and will be inserted vertically inside the tubular mesh, thus determining two from faces (21) and two side faces of said mesh as it passes over the expansion core. The device has a mechanism for inserting, in a variable way as the mesh passes over the expansion core, sections of the peripheral tubular mesh into it, thus accumulating a greater or smaller quantity of mesh in each longitudinal section of mesh corresponding with one bag unit.

9 Claims, 5 Drawing Sheets

FOREIGN PATENT DOCUMENTS

| | | | |
|---|---|---|---|
| EP | 1 481 899 | A1 | 4/2004 |
| ES | 2 157 785 | B1 | 2/2002 |
| ES | 2 188 389 | B1 | 10/2004 |
| WO | 99/15418 | A1 | 4/1999 |
| WO | 03/011692 | A | 2/2003 |

* cited by examiner

METHOD FOR ALTERING THE STORAGE CAPACITY OF A TUBULAR MESH BAG BY ALTERING THE QUANTITY OF MATERIAL PER UNIT LENGTH

This is a divisional of application Ser. No. 11/370,023, filed Mar. 8, 2006, which claims foreign priority to ES 200500583, filed Mar. 14, 2005. The entire disclosures of the prior applications, application Ser. No. 11/370,023 and ES 200500583, are hereby incorporated by reference.

TECHNICAL FIELD OF THE INVENTION

The invention refers to a device for altering the storage capacity of a tubular mesh bag during the manufacture thereof. The device is applicable to machines for the continuous manufacture of mesh bags from sections cut from a continuous roll of tubular mesh, which are particularly suitable for packaging fruit and vegetable products, such as citrus fruit or root vegetables.

The invention also refers to a mesh bag that results from using the aforementioned device for altering storage capacity.

BACKGROUND OF THE INVENTION

A large variety of machines are known for the manufacture of mesh bags from tubular mesh for the packaging of a wide range of fruit and vegetable products, such as citrus fruit and root vegetables.

One particular type of machines for the continuous manufacture of mesh bags are those which comprise feeding devices for the tubular mesh and a first and second band or sheet of heat sealable material, in addition to a means of opening the tubular mesh consisting of an expansion core, situated in a vertical floating position inside the tubular mesh, supported by at least one pair of rotating rollers outside the mesh, the axes of which are solidly joined to the machine.

In addition to the elements described above, these machines also comprise one or several traction devices, generally consisting of pairs of rollers that that rotate in opposite directions, between which the tubular mesh and the bands are forced to circulate simultaneously and together in a descending direction along the outside of the expansion core. Other common components of this type of machines are welding devices, which are responsible for welding the bands of heat sealable material to predetermined sections of the tubular mesh as it passes over the aforementioned expansion core, and devices for cutting the tubular mesh and closing the lower end of the cut section, thus forming the bottom of the bag.

The bands or sheets of heat sealable material of the resulting mesh bags are used to join the lower ends of the bag and form the bottom thereof, and to then join the upper ends of the bag after the filling thereof, thus closing it at the top. At the same time, the bands are used to print the bag's identifying information, its contents or for advertising purposes.

In the type of bags described above, problems usually occur when the storage capacity of the tubular mesh between the bottom and the mouth of the bag is not sufficient for the length of the bands that join the bottom with the mouth of said bags. For example, it can happen that as the bag is being manufactured the capacity of the tubular mesh that is pulled out is excessive for the length of the bands that are pulled out together with the mesh, the result of which are bags in which the product contained in the tubular mesh hangs out of one or both sides of the heat sealable material bands. On the other hand, when the capacity of the tubular mesh that is pulled out is not sufficient for the length of the bands that are pulled out together with the mesh, there will be a surplus space between the heat sealable material bands and the tubular mesh that contains the product, whereas the ideal situation is that the band does not lose too much contact with the tubular mesh.

It therefore becomes apparent that there is a need for a device that enables the relationship between the length of the band or bands of a heat sealable material and the storage capacity of the tubular mesh that is pulled out simultaneously and together with the bands to be regulated in order to achieve bags that, once filled with the product, maintain an optimum relationship between the storage capacity of said tubular mesh and the length of the band or bands that join the mouth with the bottom of the bags.

EXPLANATION OF THE INVENTION

In order to provide a solution for the aforementioned problem, a device is presented for altering the storage capacity of a tubular mesh bag of a heat sealable material during the manufacture thereof.

The device for altering storage capacity comprises a known form of an expansion core to which the tubular mesh is peripheral, which is essentially oblong and will be inserted vertically inside the tubular mesh, thus determining two front faces and two side faces of said mesh as it passes over the expansion core.

Essentially, the device for altering storage capacity is characterized in that it has a mechanism for inserting sections of the peripheral tubular mesh into it by pushing it in a variable way, thus accumulating a greater or smaller quantity of mesh in each longitudinal section of mesh corresponding to one bag unit as it passes over the expansion core.

According to another characteristic of the invention, the expansion core has at least one longitudinal slot in each of its side faces, which is adapted to receive the aforementioned mechanism for inserting the sections of mesh that are pushed in.

According to another characteristic of the invention, the expansion core has two longitudinal slots, in the form of notches, the expansion core having an essentially S-shaped cross-section in the section with said slots.

According to another characteristic of the invention, the mechanism for inserting the mesh sections comprises at least two insertion plates that can be moved in opposite directions, towards or away from one another, in such a way that as the insertion plates are moved towards one another they push and insert sections of the tubular mesh, fitting them into the longitudinal slots on the side faces of the expansion core, forming corresponding side folds of a variable depth along the length of the tubular mesh bag, depending on how close the insertion plates are to one another as the tubular mesh passes through the insertion device, it thus being possible to control the degree of penetration of the insertion plates into the corresponding longitudinal slots.

According to another characteristic of the invention, the device comprises a regulating mechanism that is adapted so as to control the movement of each of the insertion plates and which determines the degree of penetration thereof into the corresponding longitudinal slots.

According to another characteristic of the invention, the regulating mechanism is a hydraulic or pneumatic mechanism comprising at least one cylinder, and each insertion plate is attached to a distancing arm, which is positioned at one end of the pin of the cylinder of the regulating mechanism, in such a way that as the regulating mechanism is actuated, the travel of the pin brings about the movement of the distancing arm, thus determining the degree of penetration of the insertion plate into the corresponding longitudinal slot.

According to another characteristic of the invention, each distancing arm is attached, by the opposite end to the insertion plate, to a traveller that slides along a guide rail which is parallel to the penetration direction of the insertion plates and which is in turn attached to the pin of the cylinder of the regulating mechanism.

According to another characteristic of the invention, the traveller attached to the distancing arm that is connected to one insertion plate also slides along the guide rail along which the traveller attached to the distancing arm of the other insertion plate slides.

According to another characteristic of the invention, the plates are flat plates with rounded edges.

According to another feature of the invention, the result of using the aforementioned device for altering storage capacity that is the object of the invention is a tubular mesh bag made of a heat sealable material that can be closed by its lower end.

The tubular mesh bag is of the type that has bands of heat sealable plastic material that cover the front faces of the bag, respectively, and which are joined to the tubular mesh by at least the bottom and the mouth of the bag.

Essentially, the bag is characterized in that each of the side faces of the bag has at least one side fold of a variable depth along the length of the bag.

BRIEF DESCRIPTION OF THE DRAWINGS

In the attached drawings a preferred embodiment of the device for altering the storage capacity of a bag and the tubular mesh bag resulting from using the device that is the object of the invention is illustrated by means of a non-limiting example. In said drawings.

DETAILED DESCRIPTION OF THE DRAWINGS

Figure 1:
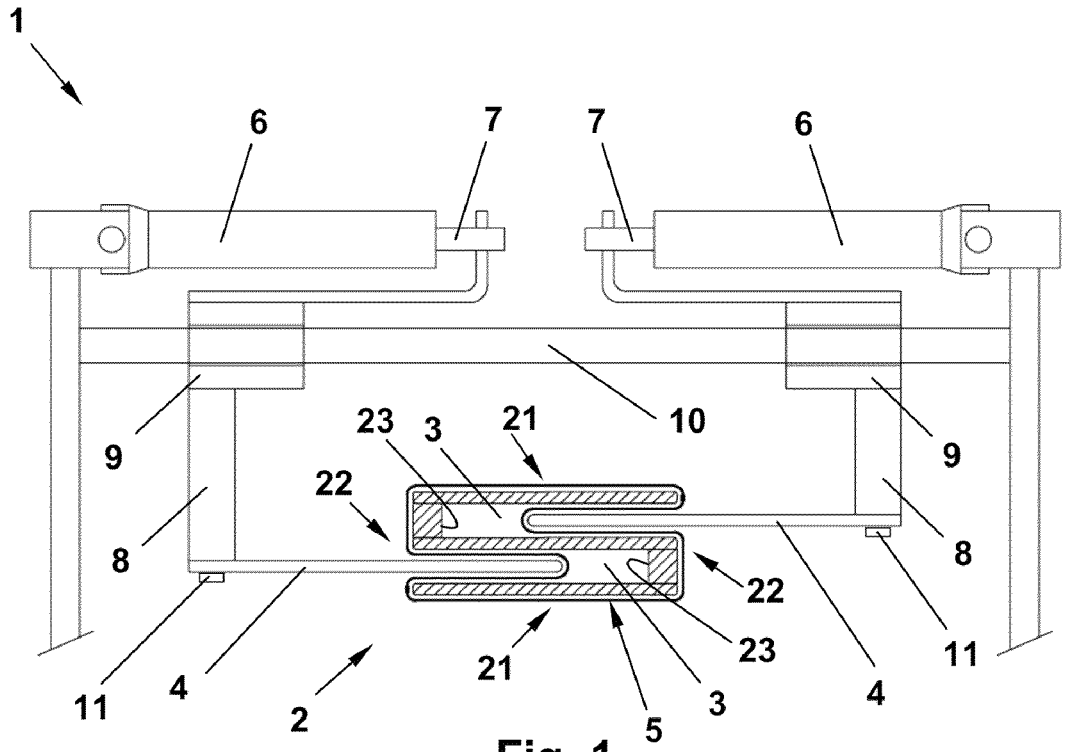
FIG. 1 is a cross-section plan view of the device for altering the storage capacity of a bag that is the object of the invention.

The device 1 for altering the storage capacity of a mesh bag 15 that is the object of the invention provides a solution for the problems usually suffered by this type of bags 15 of adjusting the length of the band or bands 13 of heat sealable plastic material to the storage capacity of the tubular mesh 5 that forms the bag 15.

Figure 9:
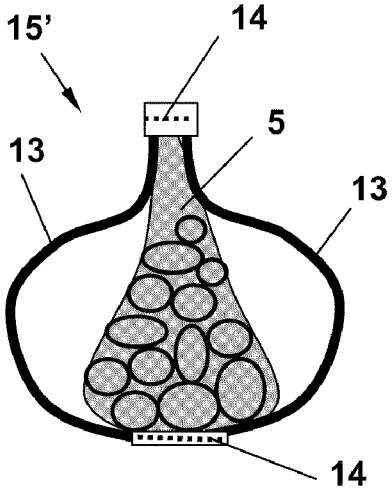
FIG. 9 is an elevation view of a bag with excessively long bands of plastic material in relation to the storage capacity of the tubular mesh.

Effectively, FIG. 9 shows a normal bag 15' made of tubular mesh 5, in which it can be observed that the bands 13 on the front faces of the bag 15' have an excessive length, as the aforementioned bands 13 do not adapt to the tubular mesh 5 when the bag 15' is full of fruit or vegetable products, such as citrus fruit or root vegetables. This is due to the fact that during the manufacture of the aforementioned bag 15', the storage capacity of the tubular mesh 5 that is pulled out does not correspond with the length of the bands 13 of heat sealable plastic material that are pulled out simultaneously and together with the aforementioned tubular mesh 5.

Figure 10:
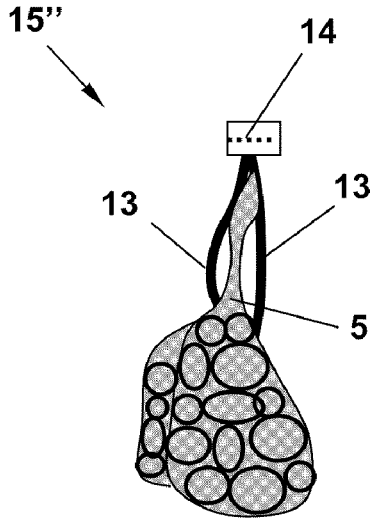
FIG. 10 is an elevation view of a bag with excessively short bands of plastic material in relation to the storage capacity of the tubular mesh.

FIG. 10 shows what happens when, contrary to the previous case, the bands 13 that have been pulled out are too short for the storage capacity of the tubular mesh 5 that forms the bag 15". The drawing shows how the tubular mesh 5 which is full of products hangs out of the side faces of the bag 15", as there is not sufficient space for it to be contained between the two bands 13.

Figure 2:
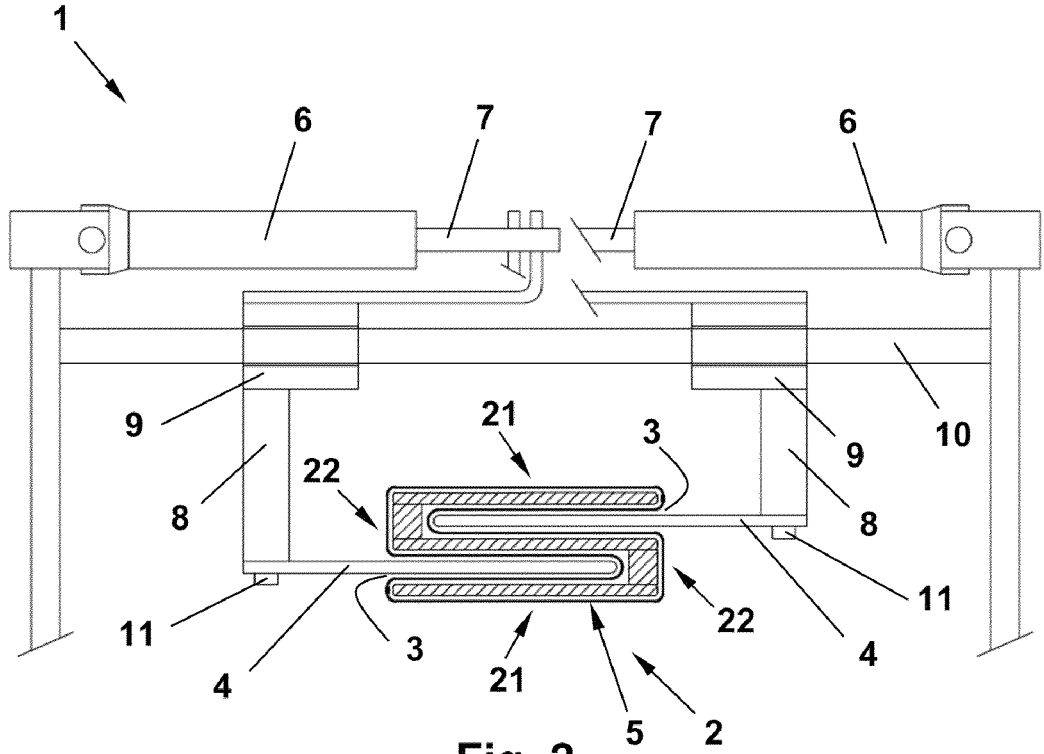
FIG. 2 is another cross-section plan view of the aforementioned device in a position of penetration that is different to that shown in FIG. 1.

FIGS. 1 and 2 show the device 1 for altering the storage capacity of a bag 15 during the manufacturing process thereof, which is applicable to a machine for the continuous manufacture of bags 15. The device 1 makes it possible to regulate the relationship between the length of the bands 13 of heat sealable plastic material and the storage capacity of the tubular mesh 5 that is pulled out simultaneously and together with the bands 13 in order to achieve bags 15 that, once filled with the product, maintain an optimum relationship between the storage capacity of the tubular mesh 5 and the length of the continuous bands 13 that are joined to the mouth and the bottom of the bags 15.

Figure 3:
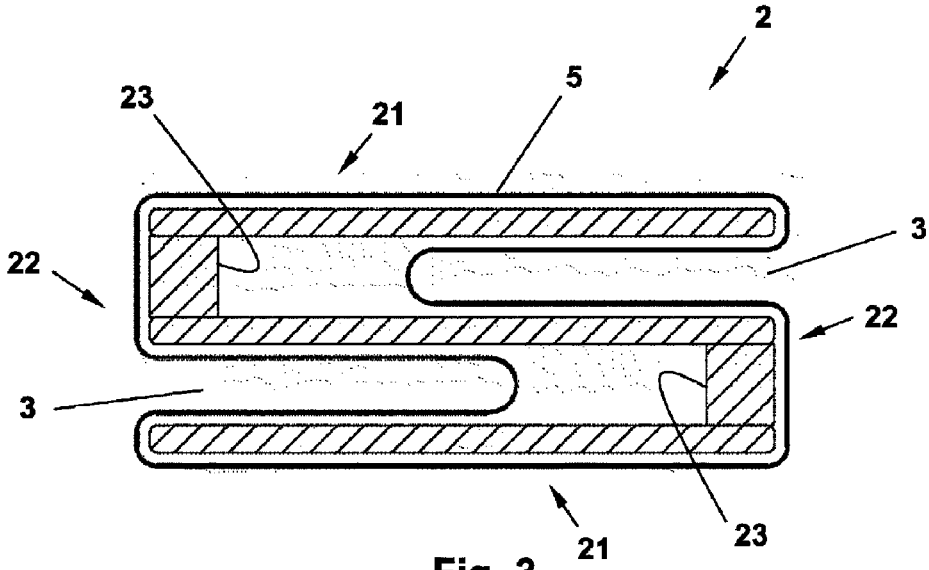
FIG. 3 is an enlarged cross-section view of the expansion core and the tubular mesh shown in FIG. 1.

The device 1 comprises an expansion core 2 to which the tubular mesh is peripheral 5, which is essentially oblong and has a longitudinal slot 3 in each of its side faces. As can be seen in detail in FIG. 3, the two longitudinal slots 3 of the expansion core 2, in the form of notches, are not coplanar and the end of each of these slots consists of an inner surface 23 on the corresponding opposite side face of the expansion core 2, thus forming an essentially S-shaped cross-section.

In one of the stages in the manufacture of a bag 15, the fixed expansion core 2 receives the tubular mesh 5 and remains inside thereof as the tubular mesh 5 is pulled down, together with the bands 13, by traction rollers that rotate in opposite directions and are situated after the expansion core 2. As the tubular mesh 5 passes over the expansion core 2, two front faces 21 and two side faces 22 are formed in the aforementioned mesh.

The storage capacity of a bag 15 is altered by inserting and accumulating a greater or smaller quantity of mesh in said longitudinal slots 3 along the length of one bag unit 15 as the section of mesh that forms one bag 15 is pulled along the expansion core 2. To do this, the device 1 has a mechanism for inserting sections of the peripheral tubular mesh 5 by pushing it into the device in a variable way as it passes over the expansion core 2, the longitudinal slots 3 being adapted so as to receive this insertion mechanism. The side folds 12 of the bag 15, which are of a variable depth, are the result of accumulating a greater or smaller quantity of mesh in the longitudinal slots 3 as it passes over the aforementioned expansion core 2.

The mechanism for inserting the sections of mesh comprises two insertion plates 4, shown in FIGS. 1, 2, 4, 5 and 6, which move in opposite direction, towards and away from one another. When the insertion plates 4 move towards one another, they push the tubular mesh 5 of the side faces 22 into the tubular mesh 5 itself by inserting mesh in a variable way into the longitudinal slots 3 of the expansion core 2. As the insertion plates 4 are inserted into the corresponding longitudinal slots 3, this creates a side fold 12 section of tubular mesh 5 in the bag 15, the depth of which depends on the degree of penetration of the insertion plates 4 into said slots.

In the situation in which the insertion plates 4 move towards one another, they push the side faces 22 of the tubular mesh 5 sections into the longitudinal slots 3 and the tubular mesh 5 is tautened by the tautness of the sides of the mesh sections that are pushed in. However, as the insertion plates 4 move away from one another, gradually being withdrawn from inside the longitudinal slots 3, the depth of the side folds 12 is reduced and the tubular mesh 5 becomes less taut and recovers its initial peripheral form before insertion of the mesh sections.

Thus, while the tubular mesh 5 descends around the expansion core 2 due to the action of traction rollers that are not shown but are situated underneath and next to the expansion core 2, the side fold 12 of each side face 22 will change in depth along the length of the bag 15 as the insertion plates 4 move towards or away from one another.

Figure 4:
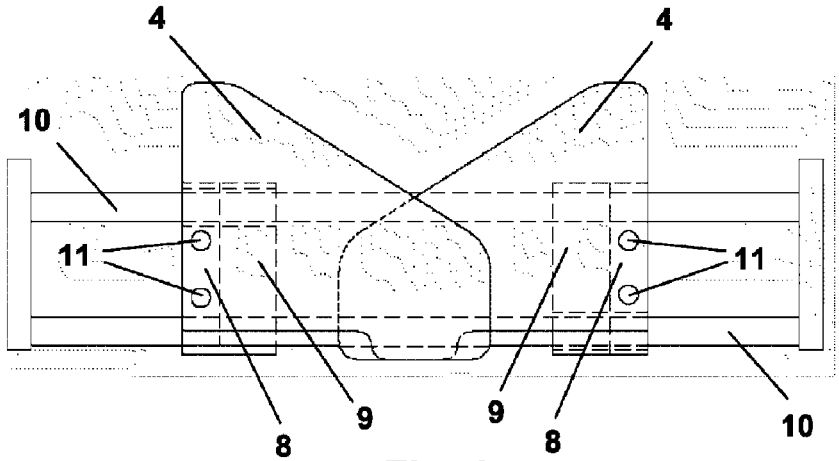
FIG. 4 is a front elevation view of the plates that form the mechanism for inserting sections of mesh.
Figure 5:
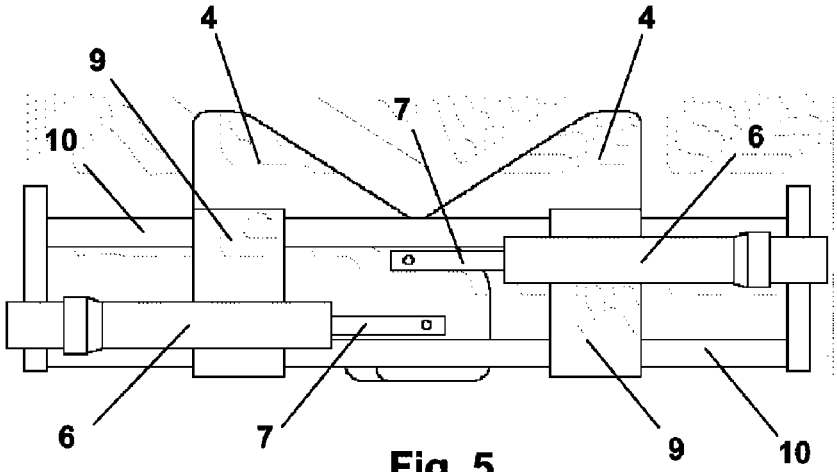
FIG. 5 is a rear elevation view of the insertion plates.
Figure 6:
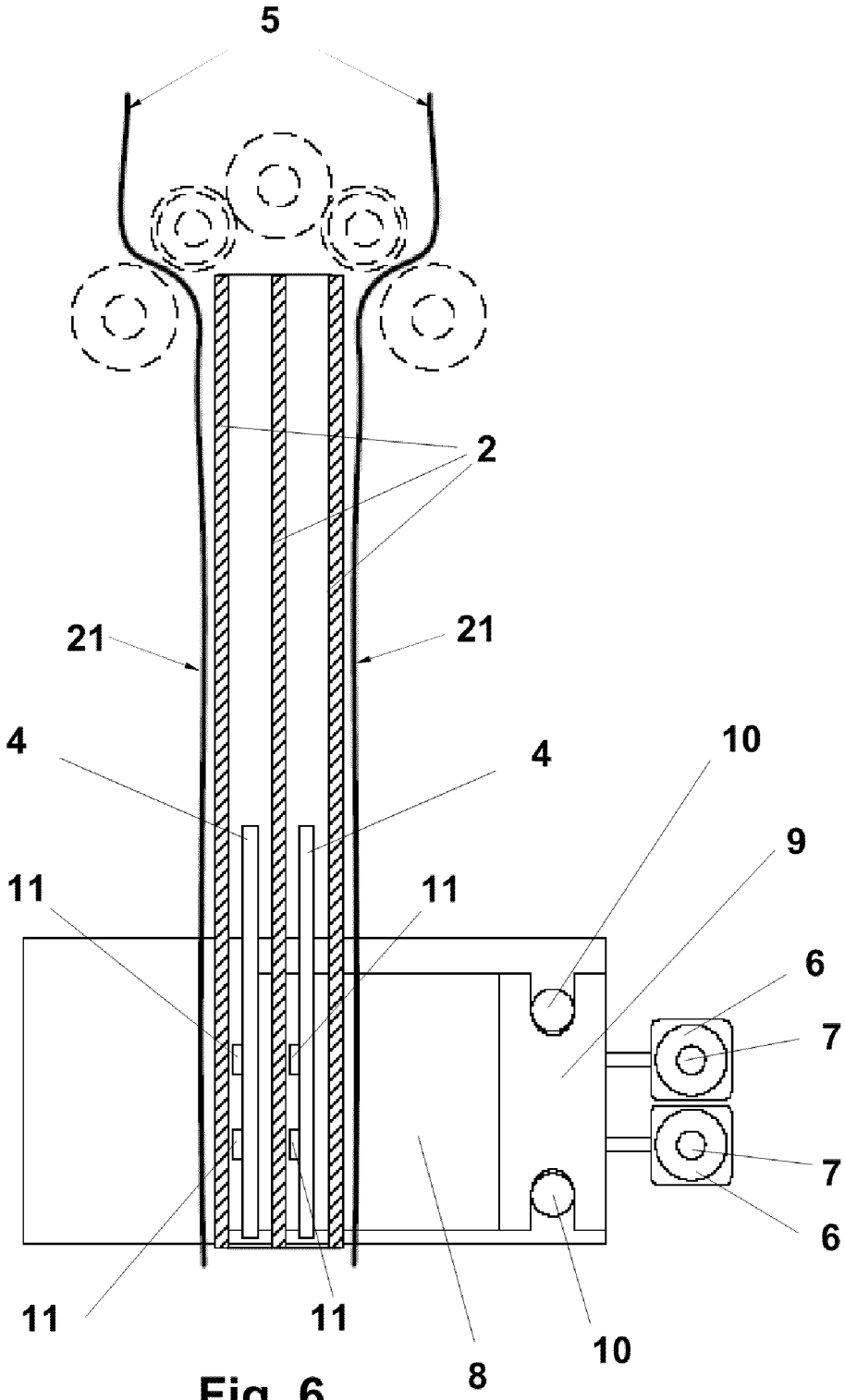
FIG. 6 is a cross-section elevation view of the device for altering the storage capacity of a bag.

The insertion plates 4 are flat plates with rounded edges to aid entry of the mesh into the longitudinal slots 3. They can take various different forms and could even be circular. FIG. 4 shows the insertion plates 4 with a triangular rectangle shape in which the acute apexes have been substituted for straight sections that are essentially perpendicular to the respective contiguous leg and joined to the hypotenuse by curved sections. The descending slope of the opposite hypotenuses aids insertion of the tubular mesh 5 section that is pushed into the longitudinal slots 3 by the straight vertical section at the end of each insertion plate 4.

The device 1 for altering the storage capacity of a bag 15 also comprises a regulating mechanism 6 that is responsible for controlling the movement of each of the insertion plates 4, thus determining the degree of penetration thereof into the corresponding longitudinal slots 3 of the expansion core. The regulating mechanism 6 can be hydraulic, pneumatic, electric, mechanical or any other known type of operating mechanism.

In FIGS. 1, 2, 5 and 6 it can be observed that the regulating mechanism 6 is of the hydraulic or pneumatic type, and that it comprises a hydraulic or pneumatic cylinder to which each insertion plate 4 is connected. The travel of each cylinder causes its respective pin 7 to move.

It can be observed in the drawings that the end of each pin 7 is connected to a traveller 9 that slides along two guide rails 10 that are parallel to one another and positioned one above the other. The axial shaft of the aforementioned guide rails 10 is parallel to the direction in which the insertion plates 4 move.

Each traveller 9 is in turn attached to a distancing arm 8. The distancing arms 8 are essentially perpendicular to the insertion plates 4 to which they are fixed by means of screws 11 or by any other system of attachment.

It should be mentioned that it is not necessary for one traveller 9 to slide along the two guide rails 10. Instead, each traveller 9, which is connected to an insertion plate 4, can only slide along one guide rail 10 that is different to the guide rail 10 along which the traveller 9 of the other insertion plate 4 moves.

According to another embodiment not shown in the drawings, the regulating mechanism 6 is of an electric type. The electric regulating mechanism 6 also comprises a pin, which is not shown, the movement of which determines the degree of penetration of the insertion plates 4 into the corresponding longitudinal slots 3. It is possible for the pin of the electric regulating mechanism 6 to be of a variable length, which extends to a greater or lesser extent depending of the degree of penetration required. The end of this pin is also attached to a distancing arm 8 that is connected to an insertion plate 4, in such a way that as the electric regulating mechanism 6 is actuated, the movement of this pin or the extension thereof bring about the movement of the corresponding distancing arm 8 and therefore the penetrating movement of the insertion plate 4.

FIGS. 1 and 2 show two different positions of penetration of the insertion plates 4. The section of tubular mesh 5 that is inserted into the longitudinal slots 3 of the expansion core 2 in FIG. 1 will produce side folds 12 in the bag 15 of a smaller depth than those obtained in the situation shown in FIG. 2. In the second drawing it can be clearly seen that the pins 7 protrude to the greatest possible extent from the bodies of the cylinders of the regulating mechanism 6, meaning that the insertion plates 4 penetrate and push into the tubular mesh 5 until it almost reaches the inner surfaces 23 of the side faces of the expansion core 2.

Obviously, should one wish to create more than one side fold 12 in each side face 22 of the bag 15, it would be necessary to change the expansion core 2 shown in the drawings for another that had as many longitudinal slots 3 on its side faces as desired side folds 12, in addition to increasing the number of insertion plates 4 in the same proportion. Furthermore, the fact that the longitudinal slots 3 are not coplanar to one another is due to the fact that it is thus possible to achieve deeper side folds 12 that may overlap one another, since in this way the insertion plates 4 do not interfere with one another as they never come into contact.

As has already been said, during the manufacture of the bags 15, the tubular mesh 5 and the front bands 13 are simultaneously pulled out together as they pass between the two traction rollers that rotate in opposite directions. In order to guarantee that they are pulled out together, it is normal to weld the tubular mesh to the bands 13 approximately in the centre of the width of the bands 13, prior to the tubular mesh 5 passing through the device 1. Each of these welding points is separated from the next by a distance corresponding to the length of one bag unit 15. Once the point has been welded, there will be a moment in which the tubular mesh 5, which is pulled out together with the bands 13, reaches the level of the insertion plates 4 of the device 1. Having reached this position, the regulating mechanism 6 that controls the degree of penetration of the insertion plates 4 into the longitudinal slots 3, force the aforementioned plates to move a certain distance away from one another, because if these penetrate too far, the tautness of the section of tubular mesh that is being pushed by the plates could cause the welding point to break. By the movement of the insertion plates 4 away from one another, as described above, the depth of the side folds 12 in the section of the bag 15 that is closest to the welding line 14, which forms the bottom of the bag 15, is smaller than in the central section.

Once the insertion of the side of the mesh by the device 1 is complete, the mesh section that comprises the welding point, following the path by which it is pulled together with the bands 13, is situated outside and underneath the device 1. This is the point at which the lower welding line 14 is made by means of welding devices at the level of the aforementioned welding point, thus forming and closing the bottom of the bag 15. The tubular mesh and the bands 13 are then cut just below the aforementioned welding line 14, in such a way that the section below this welding line 14 belongs to the bag 15 of the previous cycle with the mouth open and the top section belonging to the bag of the next cycle, the bottom of which is the aforementioned welding line 14.

By using a machine that includes a device 1 according to the invention, it is possible to correct the relationship between the storage capacity of the tubular mesh 5 and the length of the bands 13 during the manufacture of a batch of bags 15 if it is noticed, once the first bags in the manufacturing batch have been filled and closed, that this relationship is not optimum, with the bag that is finally obtained suffering any of the aforementioned defects. Thus, if it is noticed that the storage capacity should be greater, the degree of penetration of the insertion plates 4 into the expansion core 2 is increased by means of the regulating mechanism 6. On the other hand, if it is noticed that the storage capacity should be smaller, the degree of penetration of the insertion plates 4 into the expansion core 2 is modified by means of the same regulating mechanism 6, reducing the degree of penetration of said plates into the expansion core 2.

Naturally, the regulating mechanism 6 can be adapted, in a way that is itself known, to memories different degrees of penetration of the insertion plates 4 corresponding with different models of bags 15.

Figure 7:
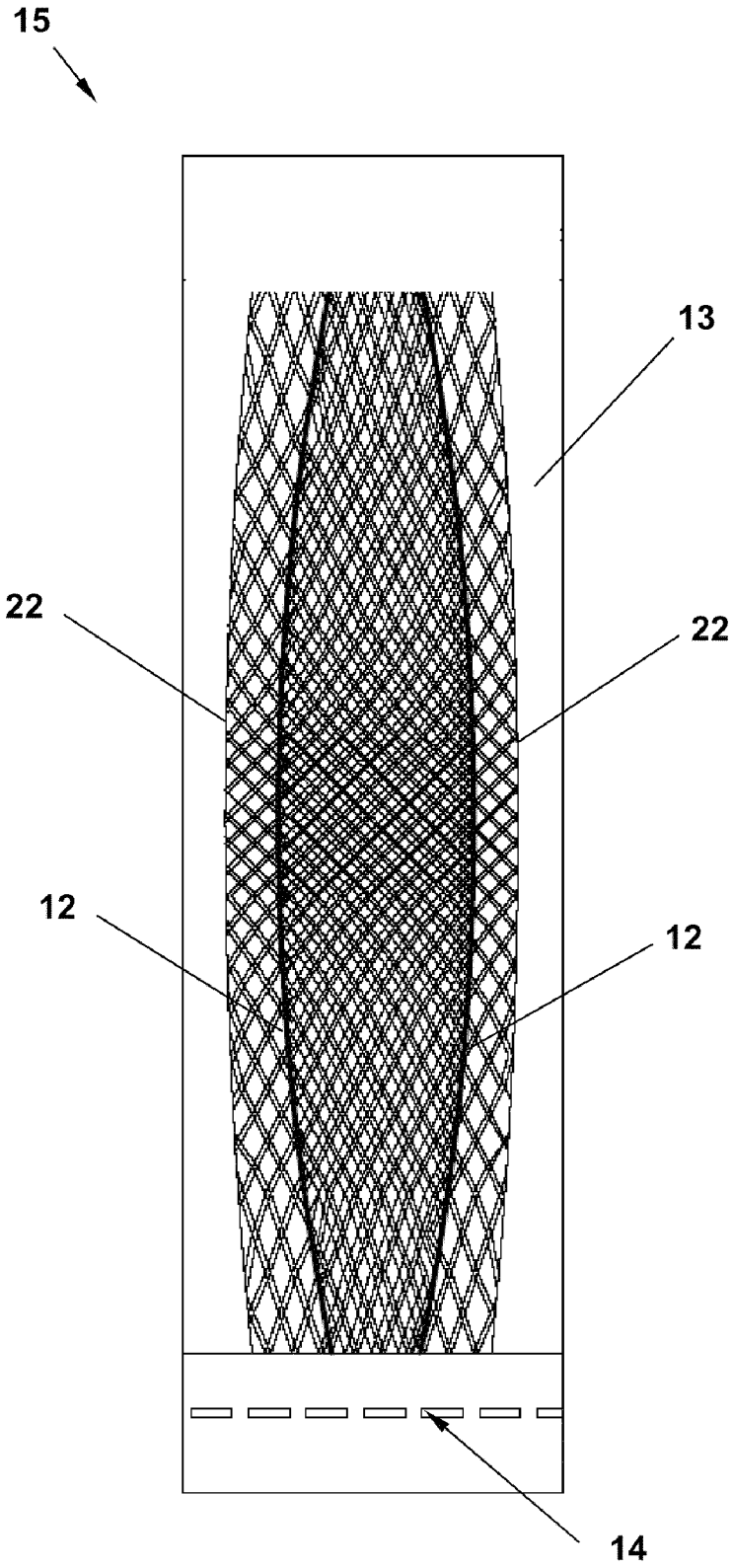
FIG. 7 is an elevation view of the tubular mesh bag resulting from using the device of the invention.
Figure 8:
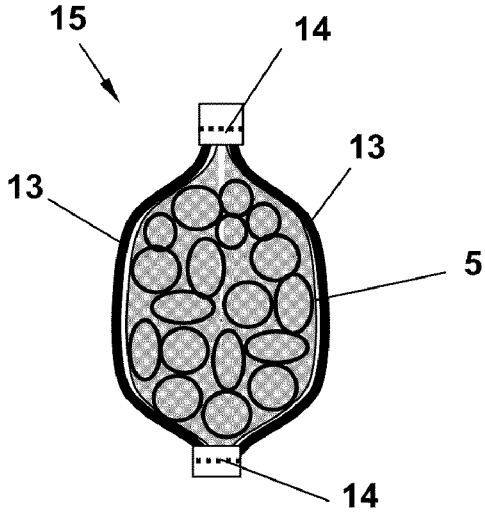
FIG. 8 is an elevation view of the bag shown in FIG. 7 filled with the product.

The tubular mesh 5 bag 15 that results from using the aforementioned device 1 for altering storage capacity, is shown in FIG. 7. FIG. 8 also shows this bag 15 once it has been filled with fruit and vegetable products, after which its mouth is closed. This drawing shows two bands 13 of heat sealable plastic material, joined at the ends of the front faces of the tubular mesh 5 of the bag 15, the bottom and mouth of which are closed by means of welding lines 14, being adapted to the volume or storage capacity of the tubular mesh 5 once it contains the fruit and vegetable products. Although the explanation below refers to a tubular mesh 5 bag 15 with two bands 13 of heat sealable plastic material joined at the ends of the tubular mesh 5, it is also applicable to bags that have only one band 13 on one of its front faces instead of having two bands 13 (one for each front face of the bag).

The tubular mesh 5 bag 15 shown in FIG. 7 shows the bag 15 in a situation prior to the filling thereof, in which the aforementioned bag 15 is flattened in such a way that the tubular mesh 5 is positioned between the bands 13 of heat sealable plastic material. Only the lower section of the front band 13 next to the welding line 14 is shown, so as to make it possible to see the folded mesh inside. In a complete drawing of the bag 15, the front band 13 would be joined at the lower end by the welding line 14 to the tubular mesh 5 and the rear band 13, whilst the upper end of the bag 15 would comprise the free upper end of the two bands 13 and the open mouth of the tubular mesh 5. Obviously, the upper end of the bag 15 must not be closed until the tubular mesh 5 has been filled with fruit or vegetable products, which is when the top of the bag may be closed by joining the ends of the two bands 13 to the mouth of the tubular mesh 5 by means of a welding line 14, for example.

FIG. 7 shows that, as a result of using the device 1, the bag 15 has side folds 12 in the mesh, the depth of which is variable along the length of the bag. These side folds 12 are areas of the side faces 22 of the tubular mesh 5 where sections of mesh have been inserted, with a greater or lesser degree of penetration, as a result of being pushed by the insertion plates 4 of the device 1. In the case shown in the drawing, the depth of the side folds 12 is symmetrical to the longitudinal axis of the bag 15, the aforementioned folds being deeper in the central section of the bag 15 than at the ends due to the aforementioned unfavorable tautness that occurs in the sections with points that are welded in order to guarantee that the tubular mesh is pulled out together with the bands 13.

As has been said, in the case shown in the drawing, the depth of the side folds 12 is greater in the central section of the bag 15. If the drawing is observed in detail, it is possible to see that the rhombuses of the tubular mesh 5 of the central section are flatter than those of the mesh at the ends. This change in shape of the lattice of the mesh indicates that the side sections of the tubular mesh 5 have been pushed and inserted by the insertion plates 4 into the longitudinal slots 3, thus forming the side folds 12.

When the bag 15 in the drawing is filled, the central section may contain more products as the side folds 12 unfold. Moreover, it is recommendable that the depth of the folds at the ends of the bag 15 are narrower, as it is precisely in the proximity of the welding lines 14 where the mesh is subjected to greater tautness as the tubular mesh 5 is pulled down together with the two bands 13 by traction rollers that rotate in opposite directions and which are situated after the expansion core 2.

The invention claimed is:

1. A method for altering a storage capacity of a tubular material during manufacture of a tubular mesh bag, the method comprising:

providing an expansion core having a free upstream end;

passing the tubular material, which is a mesh material, over the expansion core such that the tubular material is peripheral to the expansion core;

providing an insertion mechanism for inserting sections of the tubular material into the expansion core as the tubular material passes over the expansion core;

operating the insertion mechanism to insert sections of the tubular material into the expansion core so that a greater quantity of tubular material is accumulated per unit length in each longitudinal section of tubular material corresponding to one bag unit.

2. The method according to claim 1, wherein the expansion core forms two front faces and two side faces in the tubular material as the tubular material passes over the expansion core.

3. The method according to claim 2 further comprising:

providing the expansion core with a first longitudinal slot and a second longitudinal slot, wherein the first longitudinal slot is offset from the second longitudinal slot in a direction transverse to a direction of travel of the tubular material.

4. The method according to claim 1, wherein the expansion core is essentially oblong and is inserted vertically into the tubular material.

5. The method according to claim 1, wherein the insertion mechanism is operated such that the amount of tubular material that is inserted into the expansion core varies within the longitudinal section of tubular material corresponding to the one bag unit so as to vary the quantity of tubular material accumulated per unit length.

6. The method according to claim 1, wherein the insertion mechanism is operated such that the amount of tubular material that is inserted into the expansion core is constant within the longitudinal section of tubular material corresponding to the one bag unit.

7. The method according to claim 1 further comprising:

providing the expansion core with at least one longitudinal slot adapted to receive the insertion mechanism.

8. The method according to claim 7, wherein a periphery of a cross-section of the expansion core including the at least one longitudinal slot is greater than a length of a periphery of the tubular material;

wherein the cross section of the expansion core is taken in a direction transverse to a direction of travel of the tubular material.

9. The method according to claim 1, wherein the tubular material is a mesh.

* * * * *